US006611993B2

(12) United States Patent
Ray

(10) Patent No.: US 6,611,993 B2
(45) Date of Patent: Sep. 2, 2003

(54) HINGE MECHANISM

(76) Inventor: Francis M. Ray, 3307 Meadow La., Glenview, IL (US) 60025

( * ) Notice: Subject to any disclaimer, the term of this patent is extended or adjusted under 35 U.S.C. 154(b) by 0 days.

(21) Appl. No.: 09/864,997

(22) Filed: May 24, 2001

(65) Prior Publication Data

US 2002/0088086 A1 Jul. 11, 2002

Related U.S. Application Data

(60) Provisional application No. 60/209,332, filed on Jun. 2, 2000.

(51) Int. Cl.[7] ..... E05F 1/14; E05D 7/04

(52) U.S. Cl. ..... 16/280; 16/286; 16/243; 16/248

(58) Field of Search ..... 16/280, 281, 286, 16/243, 248, 50, 54, 335, 242; 220/244, 246, 263, 264

(56) References Cited

U.S. PATENT DOCUMENTS 3,825,073 A * 7/1974 Gardner et al. ..... 16/286
4,058,170 A * 11/1977 Ankenman et al. ..... 16/286
4,096,968 A * 6/1978 Treiber et al. ..... 220/244
4,165,013 A * 8/1979 Lutz ..... 220/203.07
4,568,473 A * 2/1986 Theodore et al. ..... 508/470
4,610,049 A * 9/1986 Dean ..... 16/286
4,756,444 A * 7/1988 Persson ..... 220/264
5,014,870 A * 5/1991 Kinshofer ..... 220/211
5,280,848 A * 1/1994 Moore ..... 220/264
5,290,076 A * 3/1994 Smith ..... 292/201
5,402,552 A * 4/1995 Chen ..... 16/228
6,032,420 A * 3/2000 Daoud ..... 16/321

* cited by examiner

*Primary Examiner*—Chuck Y. Mah
(74) *Attorney, Agent, or Firm*—Marshall, Gerstein & Borun

(57) ABSTRACT

A hinge mechanism for joining a door to a vessel is disclosed. The hinge mechanism includes a housing having a first end and a second end, and a rod reciprocally disposed in the housing, with the rod having a first end adapted to pivotally engage the door and further having a second end. A spring is disposed within the housing. A first coupling slidably connects a first end of the spring to the first end of the rod, and a second coupling slidably connects a second end of the spring to the second end of the rod. The spring, the housing, and the first and second couplings cooperate to permit movement of the rod between an outward position, an inward position, and a neutral position between the outward position and the inward position. The spring is arranged to bias the rod toward the neutral position.

17 Claims, 4 Drawing Sheets

HINGE MECHANISM

RELATED APPLICATIONS

This application claims priority from earlier filed U.S. provisional application Ser. No. 60/209,332, filed Jun. 2, 2000.

FIELD OF THE INVENTION

The present invention relates generally to pressure vessels. More specifically, the present invention relates to a double acting hinge for use on the door of a pressure vessel.

BACKGROUND OF THE INVENTION

On a typical pressure vessel, such as, by way of example rather than limitation, an autoclave, the pressure vessel is provided with a door mounted on a pair of hinges. The opening to the vessel commonly requires a seal, with the seal being compressed between the door and the vessel when the door is closed and secured. Known closing mechanisms are usually employed which compress the door against the vessel, thus compressing the seal in order to provide an air tight fit. The seals are usually in the form of an O-ring which surrounds the opening to the vessel.

A number of concerns exist in the prior art, including ensuring proper alignment of the hinges, providing for adequate compression of the seal, and protecting the seal from damage during opening and closing of the door. Thus, there exists a continuing need for improved pressure vessel components that address one or more of the afore-mentioned concerns.

DETAILED DESCRIPTION OF THE PREFERRED EMBODIMENT

The embodiment described herein is not intended to be exhaustive or to limit the scope of the invention to the precise form or forms disclosed. Instead, the following embodiment has been chosen and described in order to best explain the principles of the invention and to enable others skilled in the art to follow its teachings.

Figure 1:
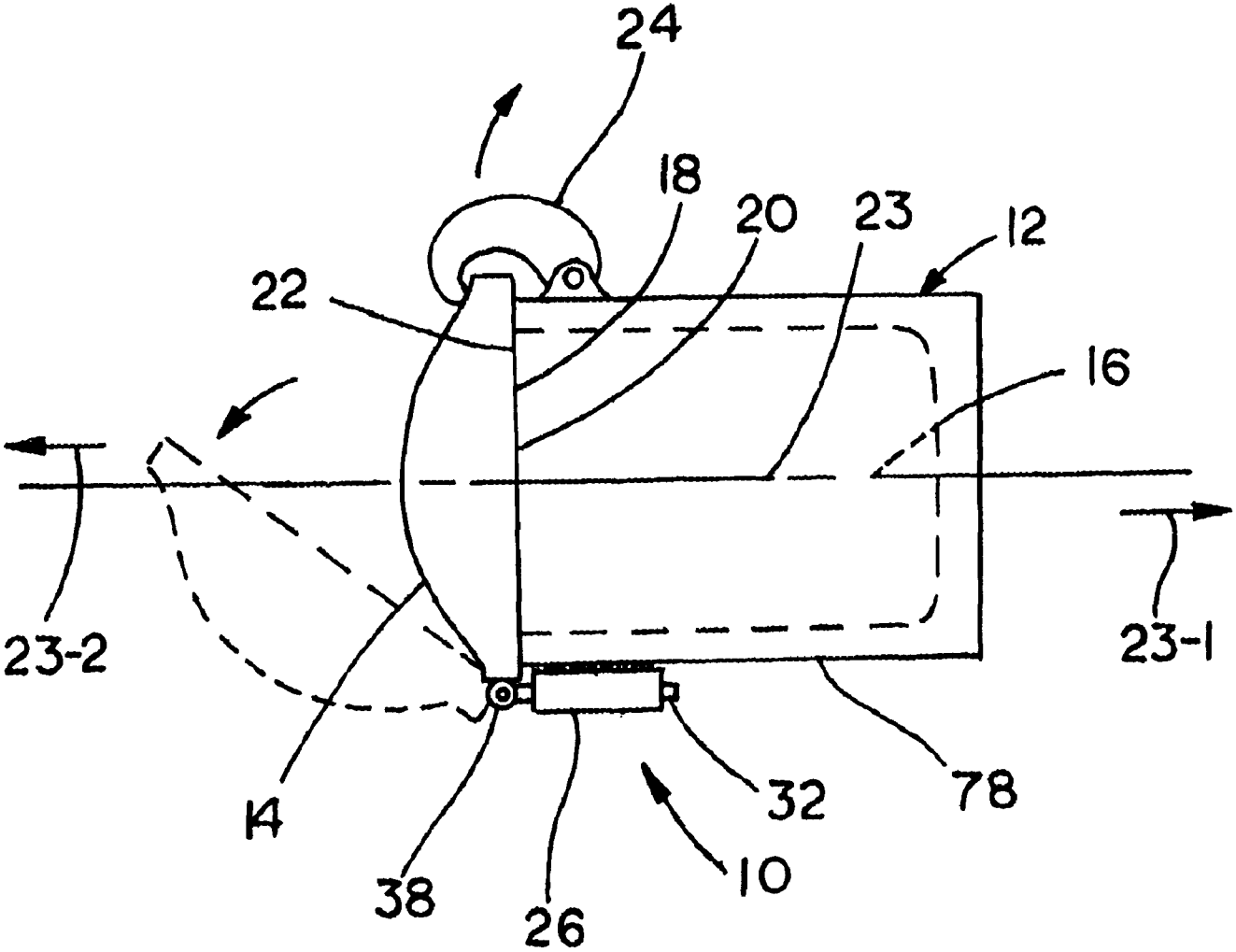
FIG. 1 is a top plan schematic view of a pressure vessel having a door mounted to the vessel by a hinge mechanism assembled in accordance with the teachings of the present invention.
Figure 2:
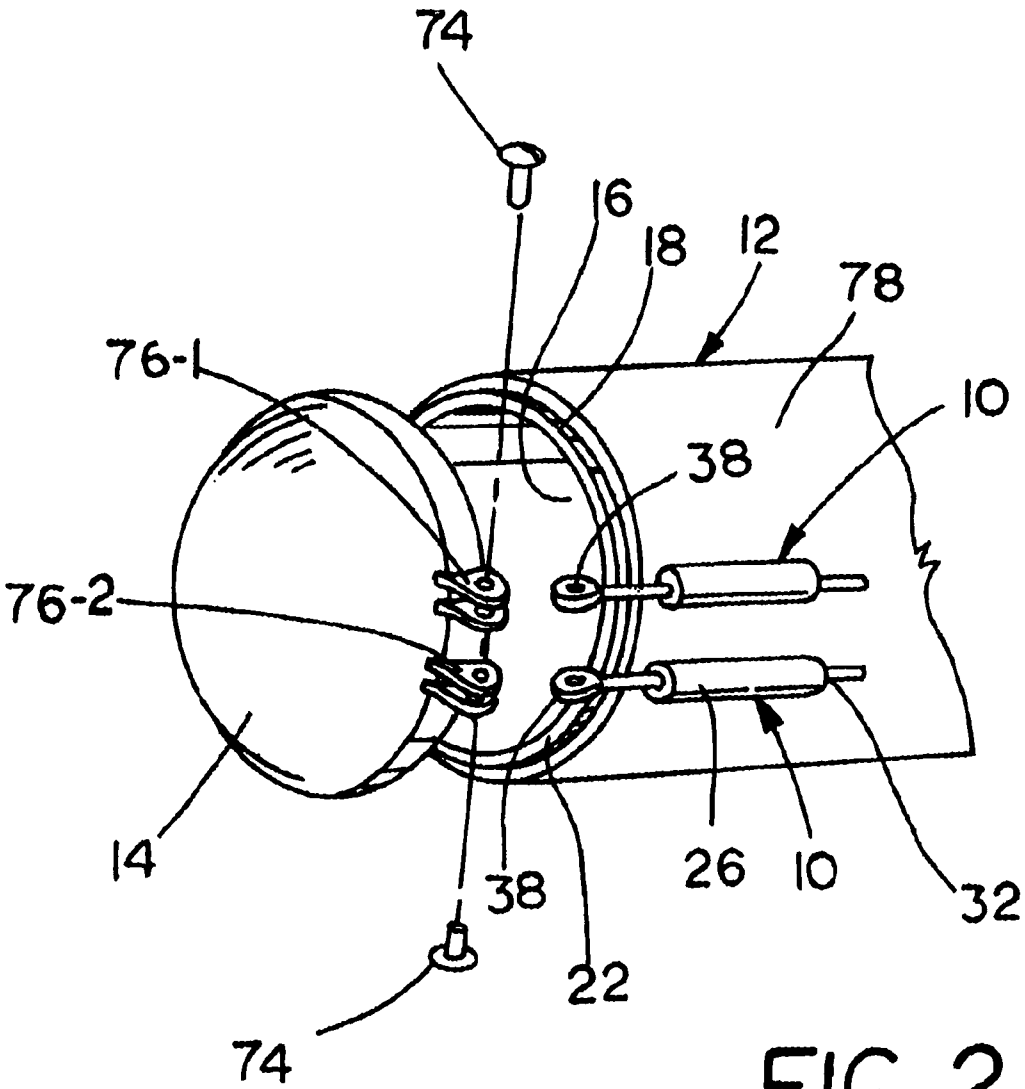
FIG. 2 is a partially exploded, fragmentary view in perspective of the pressure vessel and the hinge mechanism of FIG. 1.

Referring now to FIGS. 1 and 2 of the drawings, a hinge mechanism assembled in accordance with the teachings of the present invention is generally referred to by the reference numeral 10. The hinge mechanism 10 is shown mounted to a pressure vessel 12, with the hinge mechanism 10 pivotally connecting a door 14 to the pressure vessel 12. The pressure vessel 12 defines an interior cavity 16, with one end of the pressure vessel 12 forming a peripheral rim 18 which is arranged to receive a seal 20, such that an interface 22 between the door 14 and the rim 18 will form a pressure tight seal. The seal 20 will preferably take the form of an O-ring seal of the type commonly employed in the art. An axis 23 extends longitudinally through the pressure vessel 12, with the axis 23 generally defining an inward direction 23-1 and an outward direction 23-2. It will be understood that all references to the inward and outward directions are meant to be generally parallel to the axis 23 in either one of the inward direction 23-1 or the outward direction 23-2.

As shown in FIG. 1, one or more clamps 24 may be provided in order to secure the door 14 in the closed position of FIG. 1. Any number of commercially available clamps 24 may be employed, with the construction, function, and operation of such clamps 24 or other suitable closing mechanisms being generally well known to those of skill in the art.

Figure 3:
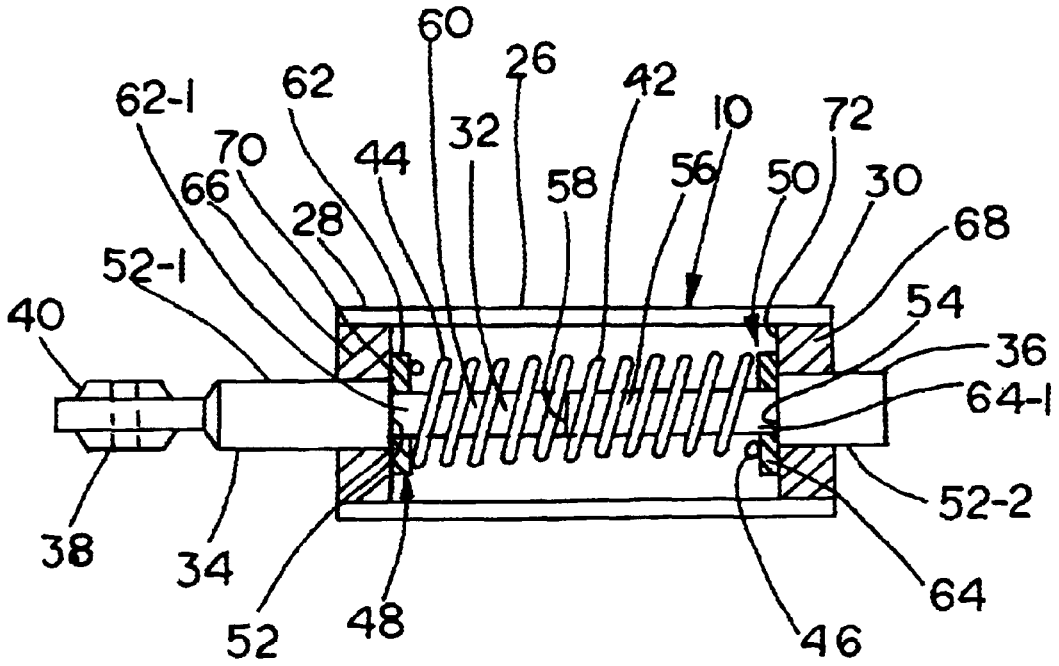
FIG. 3 is an enlarged cross-sectional view of the hinge mechanism assembled in accordance with the teachings of the present invention and illustrating the device in a neutral position.
Figure 4:
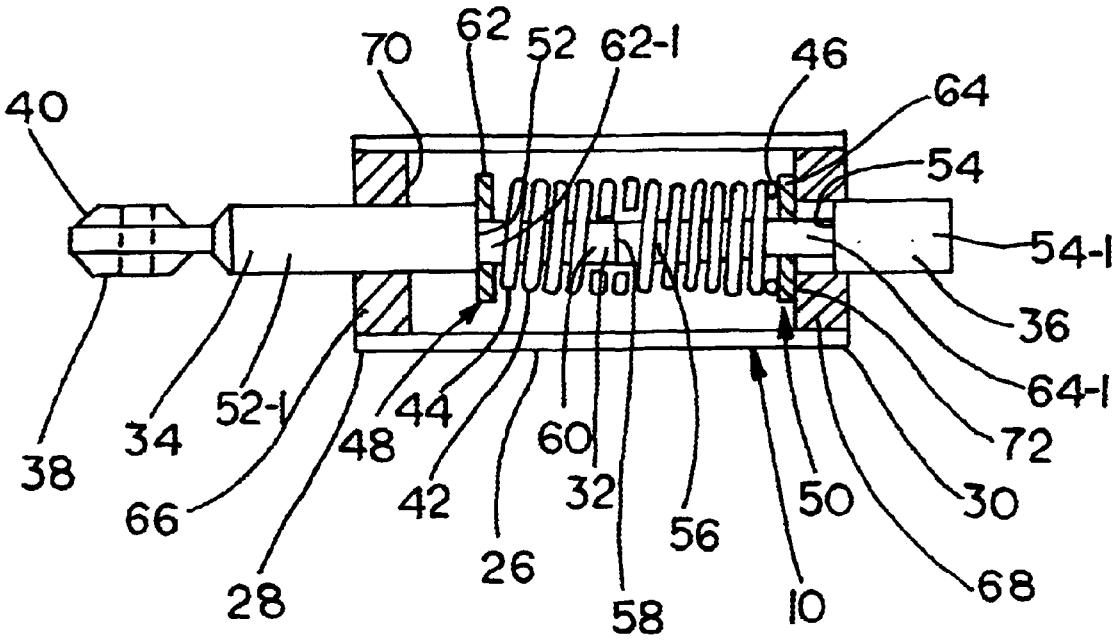
FIG. 4 is an enlarged cross-sectional view similar to FIG. 3 but illustrating the device in an inward position.
Figure 5:
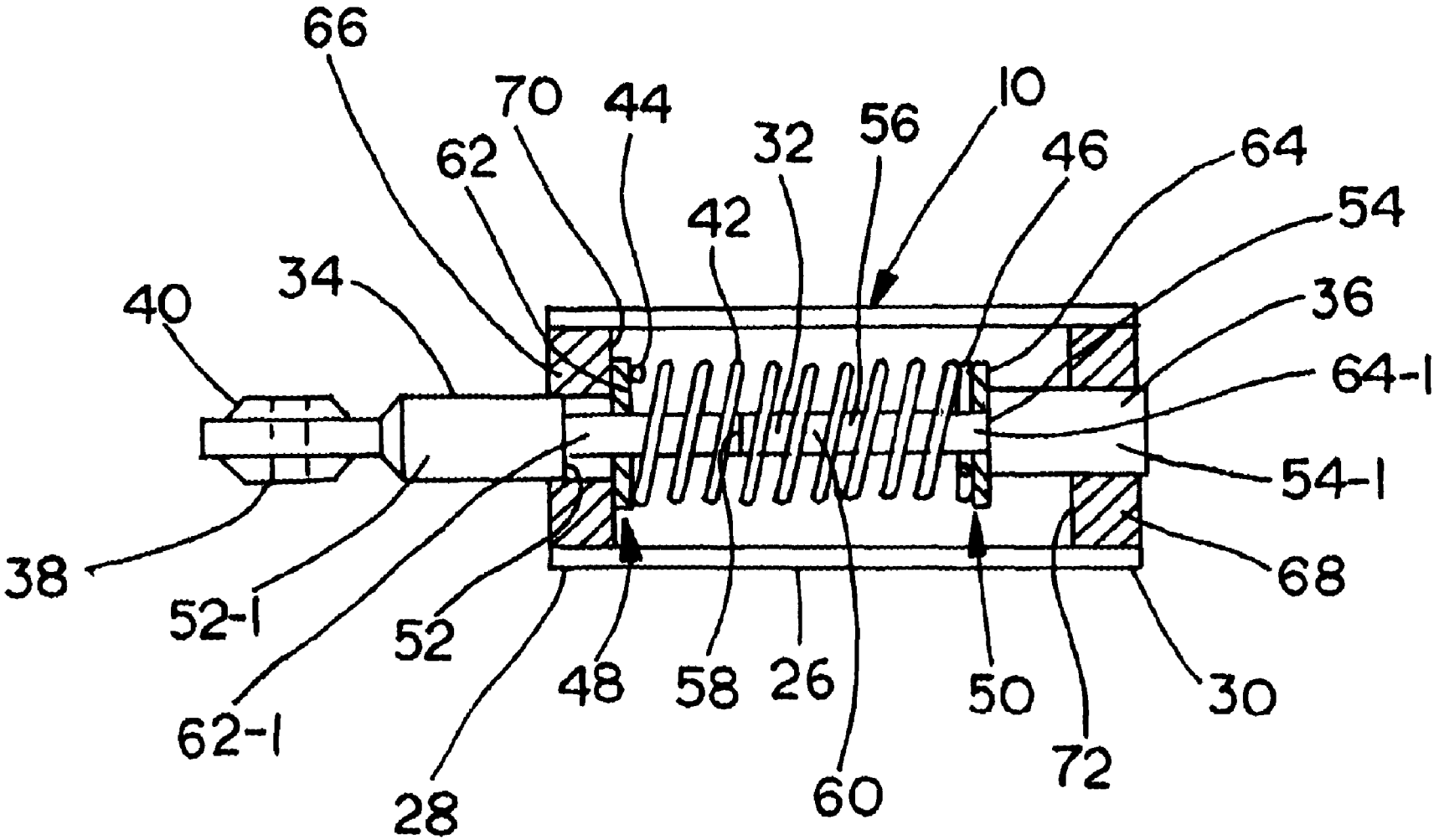
FIG. 5 is an enlarged cross-sectional view similar to FIGS. 3 and 4 but illustrating the device in an outward position.

Referring now to FIGS. 3–5, the hinge mechanism 10 is shown therein. Although the pressure vessel 10 will typically include a pair of such hinge mechanisms 10, only a single such hinge mechanism 10 will be described in detail herein, it being understood that a second such hinge mechanism will be substantially identical. The disclosed hinge mechanism 10 includes a housing 26 having a pair of ends 28, 30. In the disclosed embodiment, the housing 26 will be generally cylindrical, although other suitable shapes may be employed. An elongated rod 32 is disposed within the housing 26 such that the rod 32 will reciprocate as will be explained in greater detail below. The rod 32 includes a first end 34 and a second end 36. The first end 34 of the rod 32 generally extends from the from the first end 28 of the housing 26, while the second end 36 of the rod 32 generally extends from the second end 30 of the housing 26. The first end 34 of the rod 32 includes a pivot 38.

In the disclosed embodiment the pivot 38 may take the form of a ball rod end 40 which is attached to the first end 34 of the rod 32, such as by threads 40 (FIG. 3). Such a ball rod end 40 is commercially available from a wide variety of sources. Alternatively, the pivot 38 may be an integral part of the rod 32. Still alternatively, the pivot 38 may take the form of any one of many commercially available pivot assemblies.

A coil spring 42 is disposed within the housing 26. The coil spring 42 includes a first end 44, shown disposed toward the first end 28 of the housing 26 in FIG. 3, and a second end 46, shown disposed toward the second end 30 of the housing 26 in FIG. 3. A first slidable coupling 48 and a second slidable coupling 50 are provided. The first and second slidable couplings 48, 50 slidably connect the spring 42 to the rod 32, and enable the spring 42, the rod 32, and the housing 26 to interact in such a way that the rod 32 will be shiftable between the neutral position shown in FIG. 3, toward the inward position shown in FIG. 4 (i.e., with the rod 32 shifted toward the right when viewing FIG. 4), and the outward position shown in FIG. 5 (i.e., with the rod 32 shifted toward the left when viewing FIG. 5).

The rod 32 includes a first shoulder 52 defined generally toward the first end 34 of the rod 32, and further includes a second shoulder defined generally toward the second end 36 of the rod 32. It will be noted that when the rod 32 is in the neutral position of FIG. 3, the spring 42, by virtue of the slidable couplings 48, 50, engages both of the first shoulder 52 and the second shoulder 54. The first and second shoulders 52, 54 are separated by a central section 56 of the rod, with the central section 56 having a narrowed cross section 58 relative to a widened section 52-1 just beyond the first shoulder 52 and a widened section 54-1 just beyond the second shoulder 54. The coil spring 42 defines a central passage 60 that extends lengthwise through the coil spring 42. In the disclosed embodiment, the rod 32 extends through this central passage 60.

In the disclosed embodiment, the first and second slidable couplings 48, 50 each include a washer 62, 64, respectively. Each washer 62, 64 includes a central aperture 62-1, 64-1, respectively, sized to fit over the narrowed cross section 58 of the central section 56 of the rod 32. Further, each of the washers 62, 64 is sized to abut an adjacent one of the shoulders 52, 54. Accordingly, each of the washers 62, 64 will slide relative to the rod 32 along the central section 56, with the travel of the washers 62, 64 being limited by contact with an adjacent one of the shoulders 52, 54 (i.e., travel of the first washer 62 is limited by contact with the first shoulder 52, while travel of the second washer 64 is limited by contact with the second shoulder 54).

The housing 26 includes a first bushing 66 located at the first end 28, and a second bushing 68 located at the second end 30. The bushings 66, 68 are sized to slidably receive the widened sections 52-1 and 54-1, respectively, at the first end 34 and the second end 36 of the rod 32. The bushing 66 includes an edge 70 disposed toward the spring 42, while the bushing 68 also includes an edge 72 disposed toward the spring 42. In the disclosed embodiment, the distance between the edges 70, 72, matches the distance between the shoulders 52, 54. Consequently, the rod 32, when disposed in the neutral position of FIG. 3, will be maintained in the neutral position without having any "play" inwardly or outwardly (i.e., there will no movement of the rod 32 without the spring 42 being compressed).

Preferably, the spring 42 is in under a pre-load at all times. That is, the spring 42 is already compressed when the rod 32 is in the neutral position, with the edge 70 applying a force toward the right when viewing FIGS. 3–5, and the edge 72 applying a force toward the left when viewing FIGS. 3–5. This pre-load on the spring 42 helps to maintain the rod 32 in the neutral position. The amount of the pre-load may be varied, depending on to what degree the user wishes to have the hinge mechanism biased toward the neutral position. This pre-load may be achieved by choosing a spring 42 having a relaxed or unloaded length that is longer than the distance between the first and second shoulders 52, 54. Thus, when slidable couplings 48, 50 are assembled on the rod 32, such as by threading the ball rod end 40 in place (the first shoulder 52 may be formed by a portion of the ball rod end 40), the spring 42 will be compressed between the shoulders 52, 54 as the shoulders are brought closer together by threading the ball rod end 40 onto the rod 32.

In operation, the door 14 is mounted to the pivot 38 on each of the provided hinge mechanisms 10, such as by using a pin 74 (FIG. 2) through the ball rod end 40. Instead of the pin 74, any suitable rod, bolt, screw, or other structure may be employed. The pins 74 will secure two pairs of flanges 76-1, 76-2 (FIG. 2) to the ball rod end 40 at the first end 34 of the rod 32 on each of the hinge mechanisms 10. The ball rod end 40 will serve to accommodate slight misalignment of the hinge mechanism 10 and/or slight misalignments of the flanges 76-1 and/or 76-2. Consequently, smooth operation of the door 14 is facilitated. It will be understood that the hinge mechanisms 10 will be mounted directly to an outer portion 78 (FIGS. 1 and 2) of the pressure vessel 12, such as by welding or bolting to any suitable mounting structure, flange, etc. (not shown), which may be formed on or attached to the outer portion 78 of the pressure vessel 12 in a known manner. It will also be noted that, when the pressure vessel 12 is being prepared for operation, the clamps 42 (or other suitable closing mechanism) will apply a generally inward force to the door 14 in order to compress the door 14 against the seal 20, thus providing a more pressure-secure seal at the interface 22 between the door 14 and the peripheral rim 18. This movement of the door 14 in the inward direction will cause the pin 74 to force the rod 32 in the inward direction (i.e., toward the right when viewing FIGS. 3–5).

On the other hand, when the door 14 is opened (upon release fo the clamps 42 or other suitable closing mechanism, it may be desirable that the door 14 is able to be pulled away slightly from the peripheral rim 18, such that the door 14 may be pivoted toward the open position (shown in dotted lines in FIG. 1) without binding on one edge of the seal 20. In order to prevent binding, the door 14 (and specifically the flanges 76-1 and 76-2) may be displaced slightly in the outward direction away from the adjacent portion of the rim 18. This outward movement of the door 14 will cause the pin 74 to force the rod 32 in the outward direction (i.e., toward the left when viewing FIGS. 3–5).

Referring again to FIG. 3, when the rod 32 is disposed in the neutral position the spring 42 is preferably at least partially compressed in order to prevent play as outlined above, and in order to be under a pre-load. Thus, the first washer 62 is biased against the inner edge 70 of the first bushing 66, and is also biased against the first shoulder 52. Similarly, the second washer 64 is biased against the inner edge 72 of the second bushing 68, and is also biased against the second shoulder 54.

When the door 14 of the pressure vessel 12 is closed and drawn inwardly by the clamps 42, the rod 32 will shift inwardly by virtue of the inward force applied to the first end 34 by the pin 74. Consequently, the rod 32 will shift toward the position of FIG. 4. When this happens, the second washer 64 (abutting the edge 72 of the bushing 68) moves along the central section 56 as the shoulder 54 and the widened section 54-1 slide through the bushing 68. Thus, the hinge mechanism 10 accommodates inward movement of the door 14. Also, by virtue of the washer 62 abutting the shoulder 52 and the washer 64 abutting the edge 72 of the bushing 68, the spring 42 applies an outward biasing force to the rod 32. This outward biasing force varies with distance as the rod moves, and may be calculated using well known engineering principles based on the spring constant for the chosen spring.

On the other hand, when the door 14 of the pressure vessel 12 is to be opened, and it is desired to pull the door 14 away from the seal 20, the rod 32 will shift outwardly by virtue of the outward force applied to the first end 34 by the pin 74 (passing through the neutral position of FIG. 3). Consequently, the rod 32 will shift toward the position of FIG. 5. When this happens, the first washer 612 (abutting the edge 70 of the bushing 66) moves along the central section 56 as the shoulder 52 and the widened section 52-1 slide through the bushing 66. Thus, the hinge mechanism 10 accommodates outward movement of the door 14. Also, by virtue of the washer 64 abutting the shoulder 54 and the washer 62 abutting the edge 70 of the bushing 66, the spring 42 applies an inward biasing force to the rod 32. Again, this outward biasing force varies with distance as the rod moves, and may be calculated using the well known engineering principles based on the spring constant for the chosen spring.

According to the disclosed embodiment, the hinge mechanism provides a double action spring effect with a single spring 42. The single, double acting spring permits the door 14 to be compressed onto the seal 20, and further permits the door 14 to pull away from the seal 20 upon opening the door 14, such that the seal 20 is not damaged by the door 14 as might occur with more convention hinges. Preferably, the spring is provided with a relatively high pre-load. Further, the ball rod ends 40 provide better alignment of the door 14 with respect to the hinges 10 and the vessel 12.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A hinge mechanism for joining a door to a vessel, the hinge mechanism comprising:

a housing having a first end and a second end;

a rod reciprocally disposed in the housing, the rod having a first end and a second end, the first end being adapted to pivotally engage the door; and a spring disposed within the housing, the spring including a first end and a second end, the first and second ends operatively connected to a corresponding end of the rod by first and second slidable couplings, the first slidable coupling arranged to bias the rod in an inward direction in response to movement of the rod in an outward direction, the second slidable coupling arranged to bias the rod in the outward direction in response to movement of the rod in the inward direction, the spring, the rod, and the ends of the housing cooperating to permit movement of the rod between an outward position, an inward position, and a neutral position between the outward position and the inward position, the spring and the couplings further arranged to bias the rod toward the neutral position.

2. A hinge mechanism for joining a door to a vessel, the hinge mechanism comprising:

a housing having a first end and a second end;

a rod reciprocally disposed in the housing, the rod having a first end and a second end, the first end being adapted to pivotally engage the door; and a spring disposed within the housing, the spring slidably coupled to the rod, the spring, the rod, and the ends of the housing cooperating to permit movement of the rod between an outward position, an inward position, and a neutral position between the outward position and the inward position, the spring further being arranged to bias the rod toward the neutral position; and wherein the rod includes a first shoulder and a second shoulder, the spring including a first end engaging the first shoulder when the rod is in the neutral position and a second end engaging the second shoulder when the rod is in the neutral position, the first end of the spring moveable away from the first shoulder when the rod is shifted toward the outward position, the second end of the spring moveable away from the second shoulder when the rod is shifted toward the inward position.

3. The hinge mechanism of claim 2, wherein the first shoulder and the second shoulder are separated by a narrowed central portion, and wherein the spring is a coil spring disposed between the first shoulder and the second shoulder, the narrowed central portion extending through an elongated passage in the coil spring.

4. The hinge mechanism of claim 2, including a first washer disposed adjacent the first end of the spring and a second washer disposed adjacent the second end of the spring, each of the washers slidable relative to the rod along the central portion and sized to abut an adjacent one of the shoulders.

5. The hinge mechanism of claim 4, including a first bushing disposed adjacent the first end of the housing and a second bushing disposed adjacent the second end of the housing, the first and second bushings sized to slidably receive therein an adjacent portion of the rod.

6. The hinge mechanism of claim 2, wherein the first end of the spring is operatively coupled to the rod by a first washer, and wherein the second end of the spring is slidably coupled to the rod by a second washer, the first washer sized to abut the first shoulder and the second washer sized to abut the second shoulder.

7. The hinge mechanism of claim 6, wherein the housing includes a first bushing adjacent the first end of the housing and a second bushing adjacent the second end of the housing, the first washer coacting with the first bushing when the rod is shifted toward the outward position, the second washer coacting with the second bushing when the rod is shifted toward the inward position.

8. The hinge mechanism of claim 2, wherein the first end of the rod comprises a ball rod end.

9. The hinge mechanism of claim 2, wherein the first end of the housing includes a first bushing and the second end of the housing includes a second bushing, each of the first and second bushings having a central aperture sized to slidably receive an adjacent portion of the rod.

10. The hinge mechanism of claim 9, wherein the rod includes a pair of spaced apart shoulders bounding a narrowed central portion, a distance between the shoulders matching a distance between the bushings.

11. A hinge mechanism for joining a door to a vessel, the hinge mechanism comprising:

a housing having a first end and a second end;

a rod reciprocally disposed in the housing, the rod having a first end and a second end, the first end being adapted to pivotally engage the door; and a spring disposed within the housing and having a first end and a second end;

a first coupling slidably connecting the first end of the spring to the first end of the rod;

a second coupling slidably connecting the second end of the spring to the second end of the rod;

the spring, the housing, and the first and second couplings cooperating to permit movement of the rod between an outward position, an inward position, and a neutral position between the outward position and the inward position, the spring further being arranged to bias the rod toward the neutral position.

12. The hinge mechanism of claim 11, wherein the rod includes a first shoulder and a second shoulder, the spring disposed between the shoulders and engaging the first shoulder and the second shoulder when the rod is in the neutral position, the first coupling cooperating with the spring and the first end of the housing to apply an inward biasing force to the rod in response to movement of the rod toward the outward position, the second coupling cooperating with the spring and the second end of the housing to apply an outward biasing force to the rod in response to movement of the rod toward the inward position.

13. The hinge mechanism of claim 12, wherein the first end of the housing includes a first bushing sized to guide the first end of the rod and the second end of the housing includes second bushing sized to guide the second end of the rod.

14. The hinge mechanism of claim 13, wherein the first and second shoulders are spaced apart a distance equal to a distance between the first and second bushings.

15. The hinge mechanism of claim 11, wherein the rod includes a narrowed central portion bounded by a pair of shoulders, and wherein each of the first coupling and the second coupling includes a washer sized to slide relative to the narrowed central portion, each of the washers sized to abut one of the shoulders.

16. The hinge mechanism of claim 11, wherein the first end of the rod comprises a ball rod end.

17. A hinge mechanism for joining a door to a vessel, the hinge mechanism comprising:

a housing having a first end and a second end;

a rod reciprocally disposed in the housing and moveable between an outward position, an inward position, and a neutral position between the inward position and the outward position, the rod having a first end and a second end, the first end being adapted to pivotally engage the door; and a spring disposed within the housing;

an inner coupling engaging the first end of the rod and an outer coupling engaging the second end of the rod;

the spring operatively engaging the couplings, the spring and the couplings arranged to apply an outward biasing force to the rod in response to movement of the rod toward the inward position and to apply an inward biasing force to the rod in response to movement of the rod toward the outward posit on, the spring and the couplings further arranged to apply a centering force to the rod when the rod is in the neutral position;

the inner coupling arranged to disengage from the second end of the housing in response to outward movement of the rod and the outer coupling arranged to disengage from the first end of the housing in response to inward movement of the rod.

* * * * *